US006135410A

United States Patent [19]

Harrison

[11] Patent Number: 6,135,410

[45] **Date of Patent: *Oct. 24, 2000**

[54] RETROFIT PAN AND WATER HEATER STAND

[75] Inventor: G. Wayne Harrison, Edmond, Okla.

[73] Assignee: W. H. Safety Products, Inc., Oklahoma City, Okla.

[ * ] Notice: This patent is subject to a terminal disclaimer.

[21] Appl. No.: 09/459,155

[22] Filed: Dec. 10, 1999

Related U.S. Application Data

[63] Continuation of application No. 08/965,366, Nov. 6, 1997, which is a continuation-in-part of application No. 08/559,441, Nov. 15, 1995, Pat. No. 5,685,509, which is a continuation of application No. 08/075,652, Jun. 11, 1993, Pat. No. 5,368,263.

[51] Int. Cl.[7] ..... A47B 91/00

[52] U.S. Cl. ..... 248/346.01; 248/346.11; 248/146; 248/346.5

[58] Field of Search ..... 248/346.03, 346.06, 248/346.5, 346.11, 146, 151, 314, 154, 346.1, 310; 220/737, 212

[56] References Cited

U.S. PATENT DOCUMENTS

| | | | |
|---|---|---|---|
| 2,301,385 | 11/1942 | Ehrgott | 248/346.11 |
| 2,805,017 | 9/1957 | Hill et al. | 248/346.11 |
| 2,910,219 | 10/1959 | Bennett et al. | 248/346.11 |
| 3,519,233 | 7/1970 | Logsdon | 248/346.01 |
| 4,491,040 | 1/1985 | Corona | 248/346.5 |
| 4,998,696 | 3/1991 | Desjardins | 248/146 |
| 5,178,351 | 1/1993 | Lesage | 248/146 |
| 5,368,263 | 11/1994 | Harrison | 248/146 |
| 5,685,509 | 11/1997 | Harrison | 248/146 |
| 5,836,554 | 11/1998 | Lesage | 248/152 |

*Primary Examiner*—Leslie A. Braun
*Assistant Examiner*—Kimberly T. Wood
*Attorney, Agent, or Firm*—R. Williams Graham

[57] ABSTRACT

A pan for a stand for ignitable appliances of various sizes, comprises a base for disposal on a base foundation; a retention lip extending from the base of the pan; a support surface connected to the base of the pan and wherein the retention lip and the support surface form a retention surface area; at least one aperture surface formed adjacent the lip member and the support surface of the pan to which a drain pipe can be readily connected thereto and wherein the aperture is at least partially disposed beneath the support surface and extends through the base; and wherein the pan is operably disposable on the base foundation in a manner to support the ignitable appliance while permitting the drain pipe to be connected thereto such that fluid flows substantially from the support surface through the aperture surface enabling fluid to drain through the pipe.

9 Claims, 7 Drawing Sheets

RETROFIT PAN AND WATER HEATER STAND

This is a continuation of U.S. Ser. No. 08/965,366 filed Nov. 6, 1997 which is a continuation-in-part of U.S. Ser. No. 08/559,441 filed Nov. 15, 1995 now issued into U.S. Pat. No. 5,685,509 which is a continuation of U.S. Ser. No. 08/075,652 filed Jun. 11, 1993 now issued into U.S. Pat. No. 5,368,263.

BACKGROUND OF THE INVENTION

This invention relates to an appliance pan and stand, and more particularly, to improvements in an appliance pan and stand having a drainage system therein for support of an ignitable appliance, such as a water heater, a central heat and air conditioner or a washer/dryer.

An ignitable appliance, such as a water heater, is typically positioned within a limited space of a dwelling and on a floor adjacent the garage or within of a house or basement. Gasoline and other flammable liquids are commonly stored within the garage, and most commonly in cans on the floor. Not infrequently, these flammable liquids are spilled or leaked onto the floor and fumes emanating from these liquids tend to hover and travel low to the floor and travel into the area where the ignitable appliance is disposed. There have been a number of accidents involving an ignitable appliance, such as a water heater, wherein a pilot light of the appliance is an instrument which ignites these fumes resulting in explosion and/or fire. Thus, these ignitable appliances are to be raised above the fumes in a manner to preclude ignition thereof.

A drain is normally formed in the floor adjacent the water heater to catch water leakage from the water heater. Since leaks can occur potentially anywhere from the appliance (water heater) the leakage is not necessarily directed toward the drain and can create a mess and defeat the purpose of the drain.

There are a variety of different diameter sized appliances, e.g., water heaters, to accommodate a variety of demands. These larger sized appliances are not as common in the market place. In order to accomplish this need and reduce costs of manufacturing, it is desirable to utilize present stands having a base having a predetermined diameter and compliment the top of the stand with a retrofit pan large enough to accommodate the appliance. Further, a need exists to provide a stand with enhanced support of the appliance in extreme conditions, such as an earthquake.

Attempts have been made at providing a pan and a stand for a water heater. Such attempts have failed to provide uniformity to the industry safety standards for supporting the ignitable appliance, such as a water heater, under dry or wet conditions. Such attempts also lack height and width adjustability, fail to provide for leakage, or are designed to inhibit maneuverability for assembly and positioning within small work areas.

One type of stand described in U.S. Pat. No. 3,519,233 is directed to a water heater stand having four straight legs and a pan with a centrally located drain hole. U.S. Pat. No. 4,267,998 is directed to a wooden stand which requires on-site assembly. Another type of stand disclosed in U.S. Pat. No. 5,199,676 is directed to a sheet-like metal stand which requires assembly at the site. Similarly, this stand lacks drainage directability. Such stands either lack drainage directability, width and height adjustability or is susceptible to weakening from moisture.

There exists a need for a relatively inexpensive stand which can elevate the ignitable appliance, such as a water heater, and associated pilot light above the garage floor and/or air region of concern. There is also needed for an appliance stand in order to raise the ignitable appliance, such as a water heater, a desired height while allowing accommodation of the ignitable appliance within the housing environment. Still there is another need to have a stand which is easy to install within a limited work space wherein the ignitable appliance, such as a water heater, is housed and accommodate a variety of sized appliances. There is also a need for a stand to include a pan having a drainage system. Finally, there is a need to provide a safe and stable stand for an ignitable appliance which solves the above needs and brings uniformity to the industry.

Accordingly, stand which address and solves some of these problems are described in commonly owned U.S. Pat. No. 5,368,263 and U.S. Ser. No. 08/559,441. The present invention modifies and improves upon the invention described therein.

SUMMARY OF THE PRESENT INVENTION

It is an object of the present invention to provide a relatively inexpensive retrofit pan and stand which accommodates a variety sizes of ignitable appliances and includes a drainage system and is relatively easy to install.

It is an object of the present invention to provide a retrofit pan and appliance stand which is relatively light weight and capable of sustaining relatively heavy ignitable appliance, such as a water heater, for extended periods of time under wet or dry conditions.

It is another object of the present invention to provide for a retrofit pan and appliance stand which requires minimal or no assembly.

It is still another object of the present invention to provide for a retrofit pan and appliance stand which is relatively safe.

It is yet another object of the present invention to provide for a retrofit pan and appliance stand which is easily installed in limited a work area.

Accordingly, the invention is directed to a retrofit pan and stand for raising an ignitable appliance, such as a water heater, above a support floor a distance which is above and beyond a region of air lying adjacent the floor which is susceptible to containing flammable fumes emanating from flammable liquids on the floor. The stand includes a base of a predetermined height to raise the ignitable appliance a sufficient distance above the region of air. The base has a support surface for supporting the ignitable appliance and a retention lip member extending from the support surface to retain leakage from the ignitable appliance. Adjacent the retention lip member and the support surface there is at least one preformed threaded aperture formed in a recessed cup surface which provides an opening to which a drain pipe can be threadedly connected thereto. The support surface is preferably arcuately shaped to aid drainage in this regard. In the preferred embodiment, the base is tapered from wide to narrow from the bottom to top of the stand, respectively.

The pan has a base with a diameter larger than the retention lip of the stand and having an outer lip member extending from the base and has a support surface interconnecting an inner portion of the lip member. The lip member likewise has at least one preformed threaded aperture formed adjacent at least one of the lip member and support surface of the pan which provides an opening to which a drain pipe can be threadedly connected thereto. The support surface of the pan has at least one support rib which connectedly extends along a bottom surface of the support surface in a manner to provide stability to the support surface of the pan. The rib is configured to seat on the support surface of the stand. More particularly, the rib of the pan support surface shall provide self-orienting aspect with respect to the support surface of the stand in a manner to substantially prevent a degree of freedom of movement therebetween.

One embodiment of the an appliance stand for supporting ignitable appliances of various sizes, comprises four generally trapezoidal side panels of a predetermined height and width, each panel having two ends, wherein each end of one of the panels connects to one end of another of the panels such that the side panels interconnect to form a substantially trapezoidal base. The stand has a generally rectangular top support panel having four edges, wherein each edge is connected to an edge of each side panel. The stand has four generally trapezoidal retention lip members of a predetermined height and width connected to an edge of the top support panel and extend substantially along a common plane with the side panel interconnecting thereto, the retention lip members having two ends, wherein each end of one of the retention lip members connects to one end of another of the retention lip members such that the retention lip members interconnect, wherein the top support member and retention lip members form a retainer surface area, at least one threaded aperture surface being formed in a recessed cup surface adjacent one of the retention lips and the support surface to provide an opening adapted to receive a drain pipe thereto. The top support panel is slightly dome shaped to aid drainage. The base is formed with a plurality of ribbed sections to lend strength to the base. In this case, the pan has a rib which extends between the retention lips to maintain the pan in a horizontal fixed position therebetween.

Another embodiment of the appliance stand for supporting ignitable appliances of various sizes, comprises a generally frustoconical base member of a predetermined height and width and a generally circular top support member having a peripheral edge, wherein the edge is connected to an edge of the base member. The stand includes a generally frustoconical retention lip member of a predetermined height and diameter connected to an outer surface of the top support member and extends from the peripheral edge of the top support member in a common direction with the base member, wherein the top support member and retention lip member form a water retainer, the threaded aperture surface being formed in a recessed cup surface adjacent the retention lip and the support surface to provide an opening surface adapted to receive a drain pipe thereto. Preferably, the top support member is slightly dome shaped. The base if formed with a plurality of ribbed surfaces to lend strength thereto. Likewise, the pan has a rib which extends between the retention lips to maintain the pan in a fixed position therebetween Other features and advantages of the invention will be apparent to those skilled in the art upon review of the following drawings, detailed description and claims appended hereto.

DETAILED DESCRIPTION OF THE PREFERRED EMBODIMENTS

Figure 1:
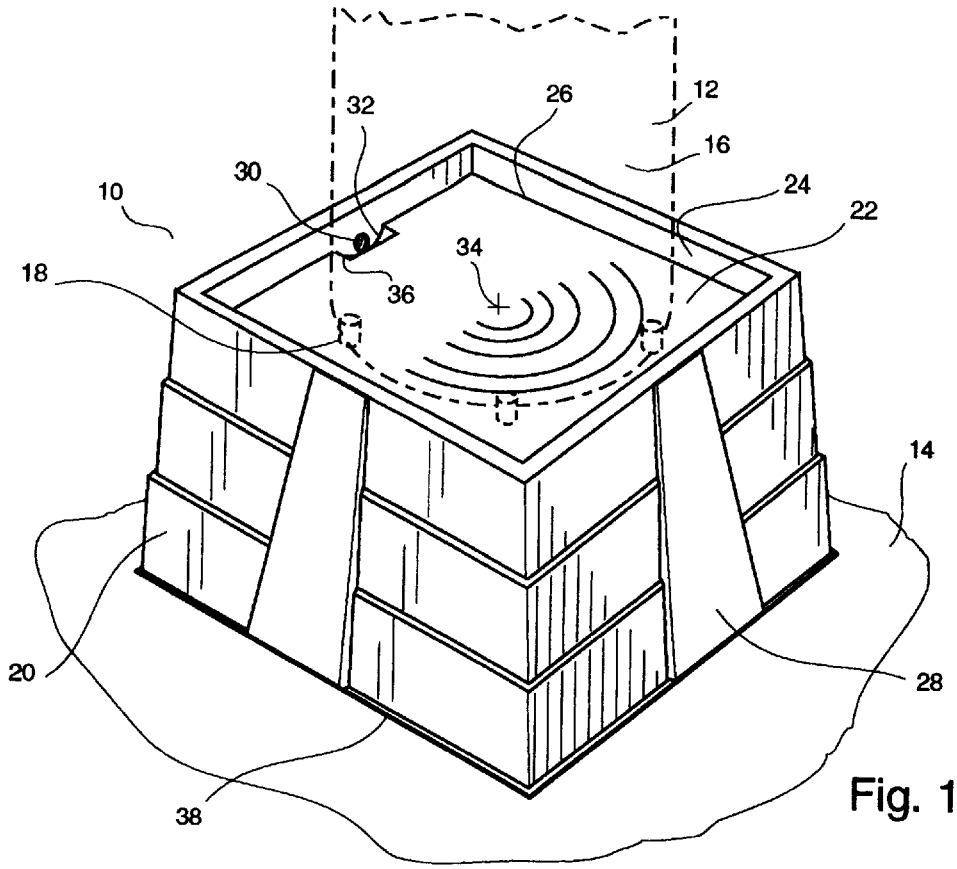
FIG. 1 is a perspective view of a stand for use in one embodiment of the present invention supporting an ignitable appliance.

Referring to the drawings, stands 10, 40 and retrofit pans 100, 100' support ignitable appliances 12 and 120, respectively, above a support floor 14. The ignitable appliance 12 is of a typical size ranging between about 18–20 inches in diameter and ignitable appliance 120 is of a typical size ranging between about 20–24 inches in diameter. The ignitable appliances 12 and 120 are water heaters of differing sizes and each have a generally cylindrical tank housing 16 and 126, respectively, and optionally a base or support legs 18 and 128, respectively, which is typically an inch or two inch height.

The stand 10 and pan 100' are one complimentary embodiment and stand 40 and pan 100 are another. Each pair will be more fully discussed hereinafter.

The stand 10 and retrofit pan 100' are of a width to accommodate and support different sized ignitable appliances 12 and 120 with or without its legs 18 and 128, respectively. The stand 10 comprises side panels 20, support surface 22, retention lip members 24 and a plurality of support ribs 25 and 27 connected to a bottom side of a support surface 22. The panels 20, support surface 22, retention lip members 24 and support ribs 25 and 27 are preferably integrally formed and are made of a plastic material such as polyethylene, cellulosic, polystyrene, acrylic polymers, fluorocarbon resins, nylon, phenolics, polyamides, and silicones, or engineering plastics for sustaining heavy loads, such as polycarbonates, ABS resins, polyvinyl chloride, PPO/styrene and polybutylene terephthalate. Ingredients such as curatives, fillers, reinforcing agents, colorants and fire retardant agents known to the art may be included in the plastic material to achieve a desired set of properties. For example, to provide adequate support for the ignitable appliance, the side panels 20 and support surface 22 thicknesses will vary depending upon the type of plastic materials chosen. Preferably, it will be desirable to form the stand 10 of plastic material which is light weight, fire retardant and capable of sustaining loads in excess of 600 lbs.

The retrofit pan 100' includes a base 130' larger diameter than that of the stand 10, a retention lip 140' extending from the base 130', a support surface 160' connected to the base 130' in a manner to form a retention area between the retention lip 140' and support surface 160'. Also, included are a plurality of support ribs 170' and 180' connected to a bottom side of the support surface 160' and are configured to seat on the support surface 22 of the stand 10. The retrofit pan 140' is likewise made of a material as previously described and is preferably integrally formed.

The ribs 170' extend radially inwardly from the base 130' toward a central area 190'. The ribs 180' are generally concentrically positioned in spaced relation to one another. Together, the ribs 170' and 180' form a lattice structure highly suitable for supporting the appliance 120'.

Figure 5:
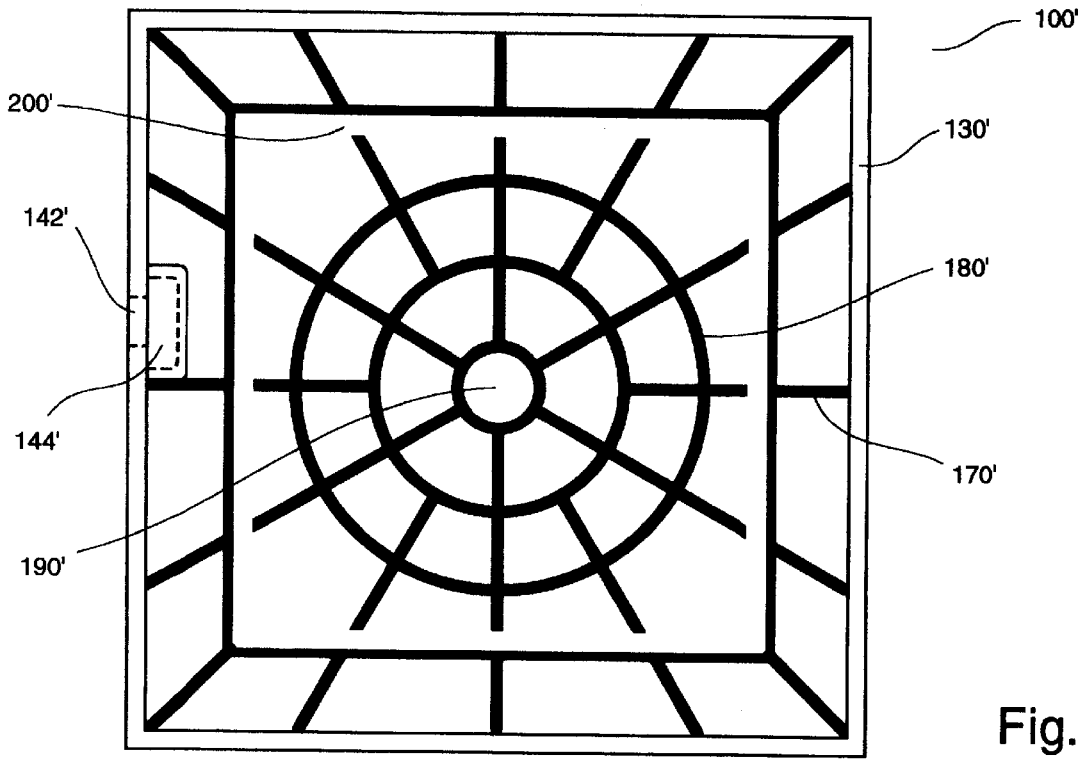
FIG. 5 is a bottom view of the retrofit pan of FIG. 3.
Figure 6:
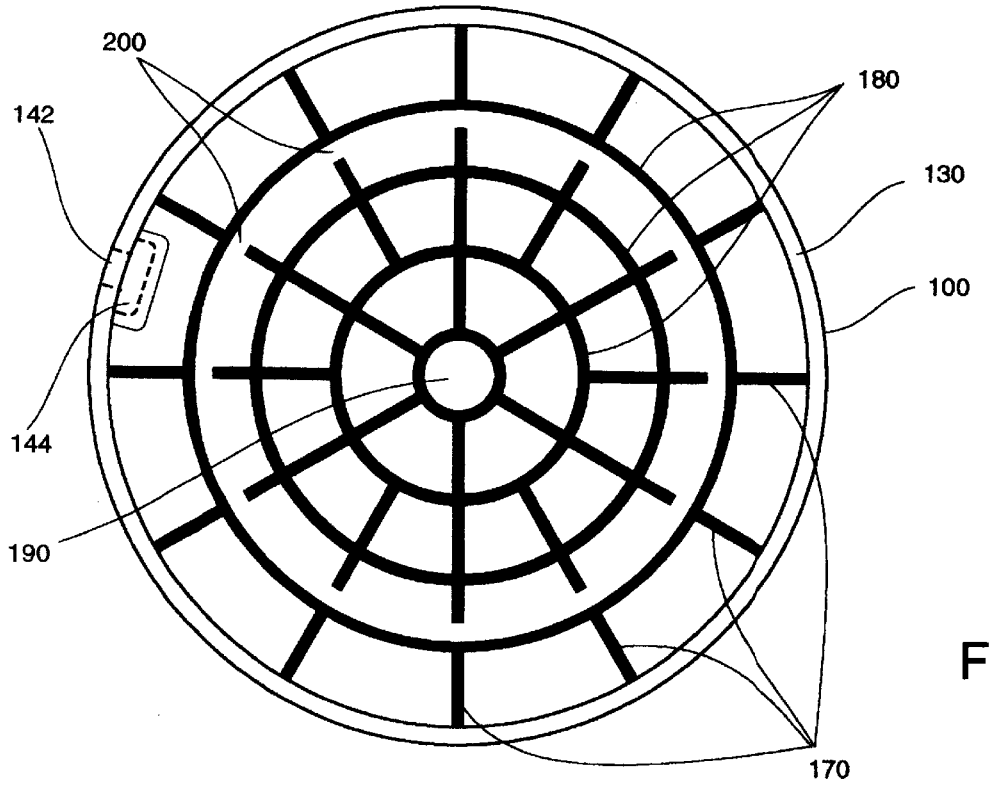
FIG. 6 is a bottom view of the retrofit pan of FIG. 4.
Figure 7:
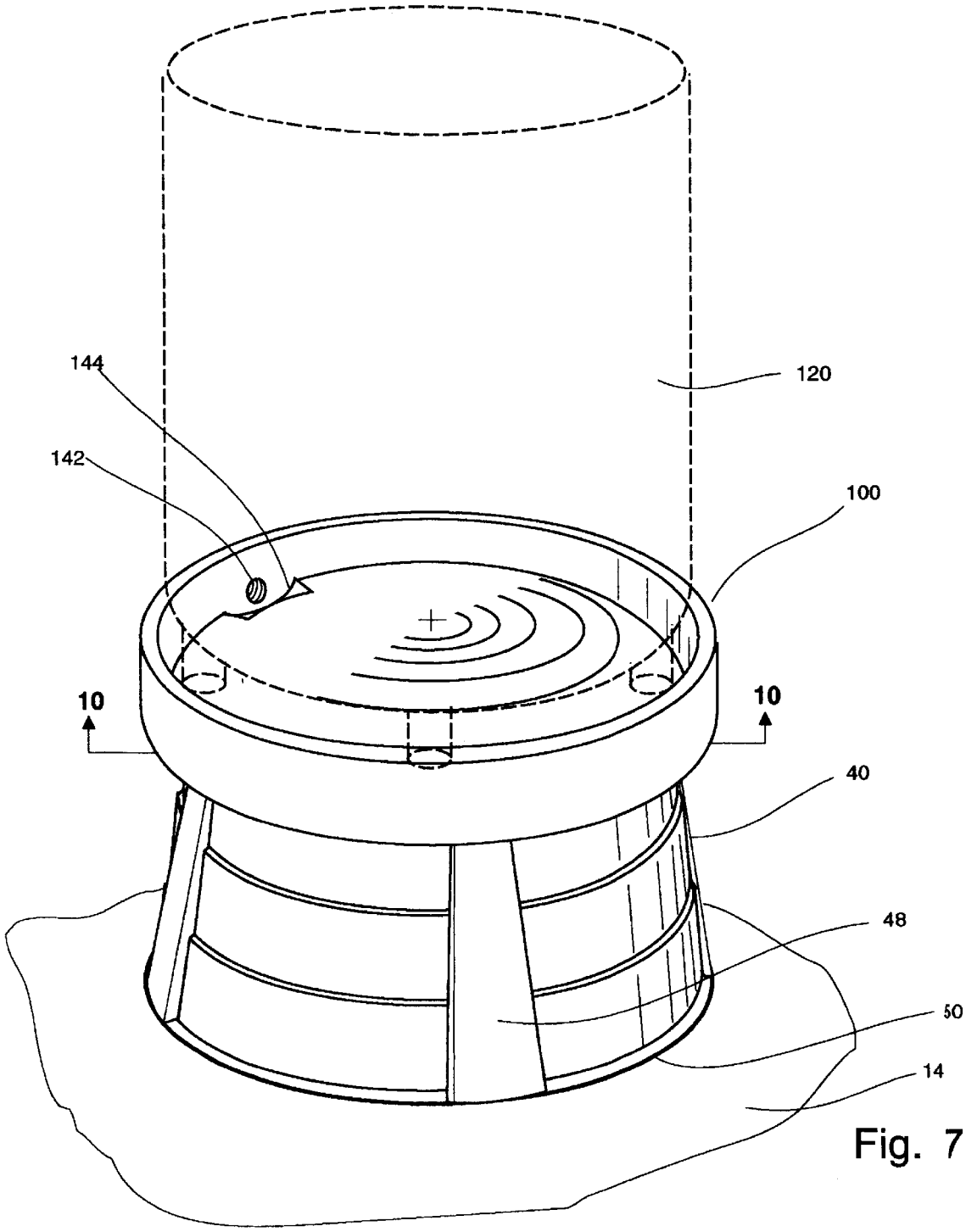
FIG. 7 is perspective view showing an oversized ignitable appliance on the retrofit pan of FIG. 4 and stand of FIG. 2.
Figure 8:
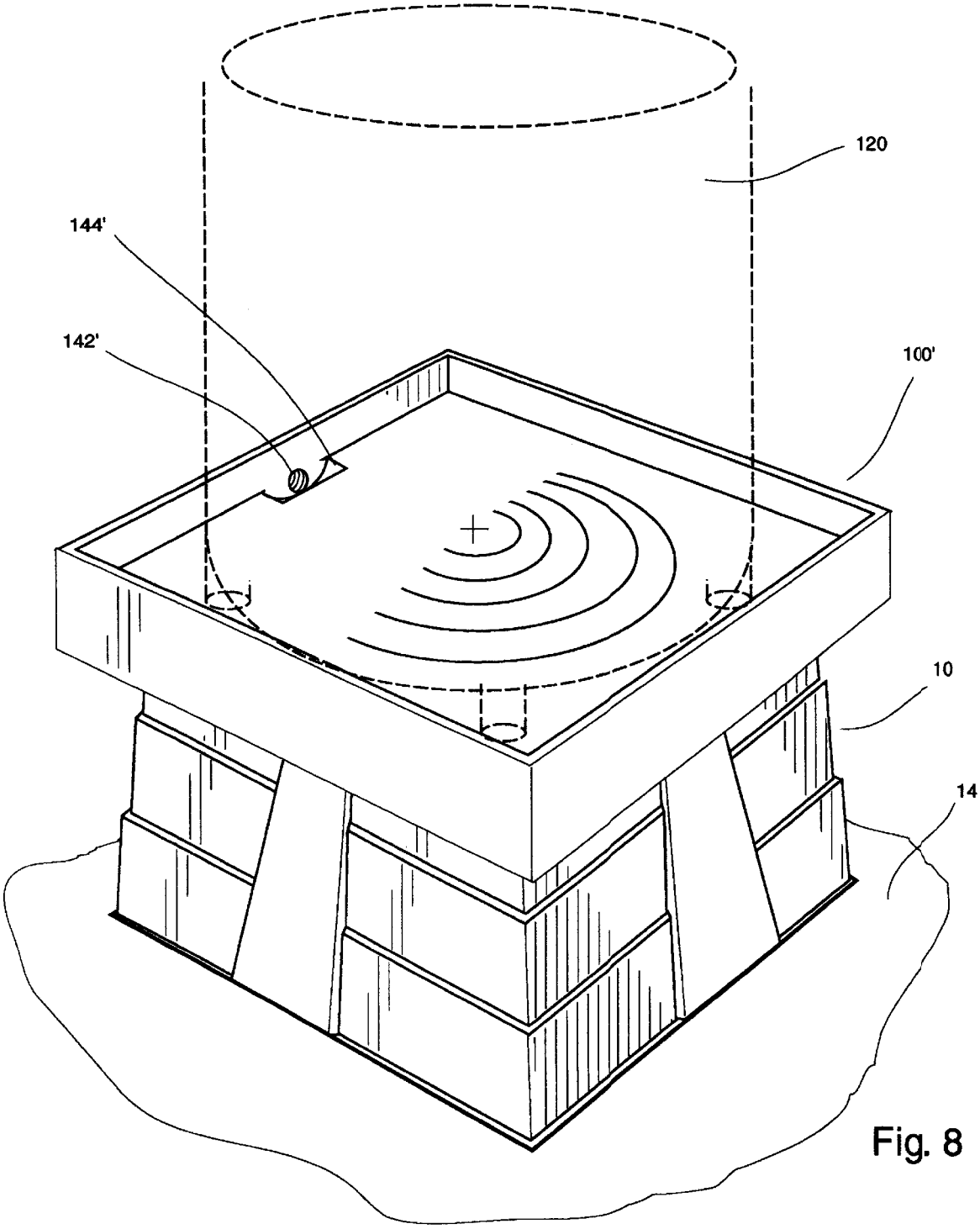
FIG. 8 is perspective view showing an oversized ignitable appliance on the retrofit pan of FIG. 3 and stand of FIG. 1.
Figure 9:
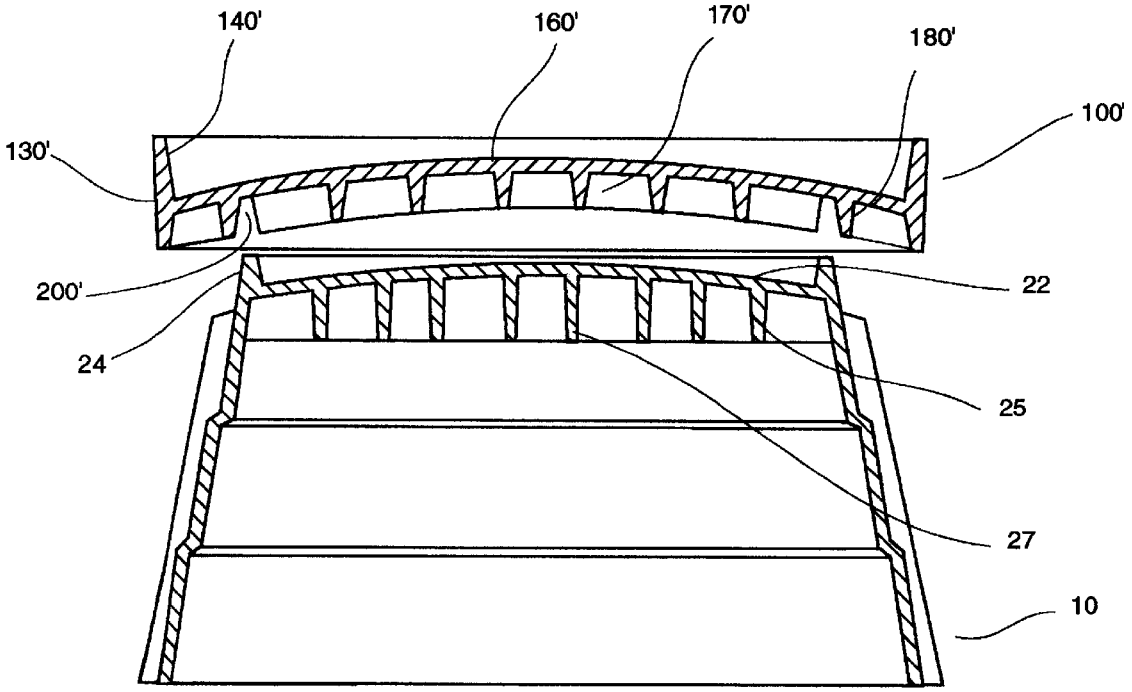
FIG. 9 is a center cross sectional view of the retrofit pan of FIG. 3 and stand of FIG. 4 in a spaced relation to one another.

An open surface area 200' seen in FIGS. 5 and 9 is used to receive the retention lip 24 of the stand 10. In this way, the retrofit pan 100' is locked in place against horizontal freedom of movement.

Each of the retention lip members 24 preferably extends from the outer edges 26 of the support surface 22 in a plane common to its respective side panel 20 and in manner such that a tapered structure is formed wide to narrow from bottom to top, respectively. This allows for the stand 10 to be nested one on top of the other in a relatively stable fashion. The height of the retention lip members 24 is to be minimized so that the members 24 do not cause an interference when moving the ignitable appliance 12 for installation and removal thereof.

The side panels 20 are also formed with ribbed support surfaces 28 which are substantially equidistantly spaced from one another. The ribbed support surfaces 28 are of a size and configuration to avoid inhibiting the nesting function of the stands 10.

Adjacent the retention lip members 24 and the support surface 22 is formed a preformed threaded aperture 30 in a recessed cup surface 32. The prethreaded aperture surface 30 is formed such that a drain pipe can be readily attached and enable direction of leakage and connection to a floor drain. Similarly, the retention lip member 140' and support surface 160' have a preformed threaded aperture 142' formed in a recessed cup surface 144'.

Alternatively, the stand 10 is formed of a plastic material which allows the surfaces 30 and 142 to be self-threading. Additionally, the pipe may be solvent welded about the surface 30 and 142. In this regard, the recessed cup surfaces 32 and 144 permit adequate access to attach and secure the pipe to the surfaces 30 and 142.

The support surfaces 22 and 160' are slightly arcuate or dome shaped to aid drainage to the recessed cup surfaces 32 and 144', respectively. However, the support surfaces 22 and 160' are of a minimal pitch to allow for quick and stable placement of the ignitable appliance 12 and 120, respectively, thereon. For example, a pitch of approximately one quarter inch from a center point 34 of the support surface 22 to the point 36 of the support surface 22 adjacent the recessed cup surface 32. The pitch of the support surface 160' is similarly formed. Finally, a bottom portion of each side panel 20 includes an anchor lip 38 to permit anchoring of the stand 10 to the floor 14.

Figure 2:
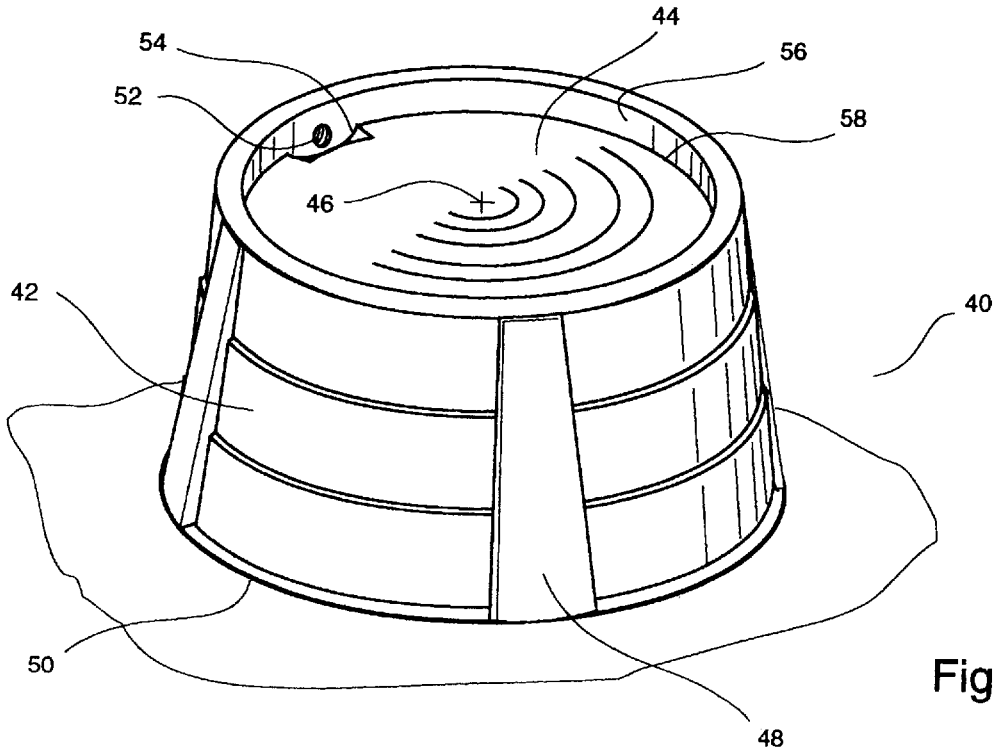
FIG. 2 is a perspective view of a stand for use in another embodiment of the present invention.
Figure 3:
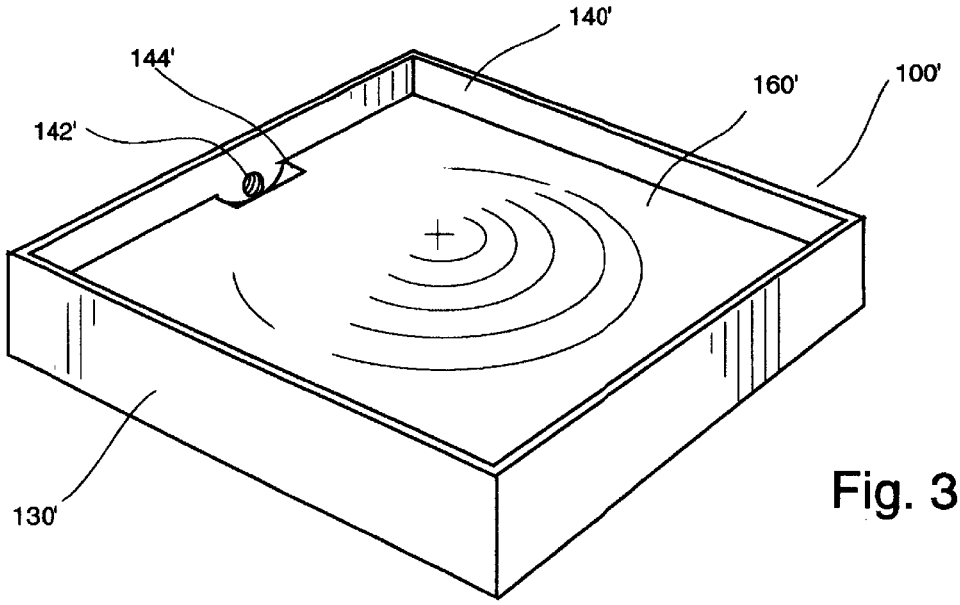
FIG. 3 is a perspective view of a retrofit pan of one embodiment of the present invention for use with the stand in FIG. 1.
Figure 4:
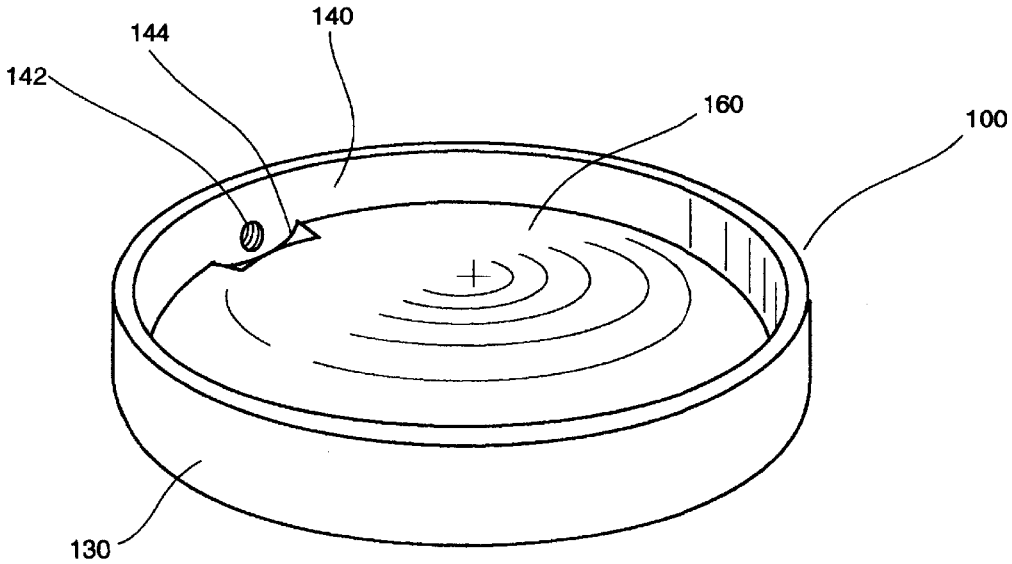
FIG. 4 is a perspective view of another embodiment of the retrofit pan for use with the stand in FIG. 2.

Referring to FIG. 2, stand 40 is shown. The stand 40 includes a generally frustoconical base panel 42, support surface 44 having a center point 46, ribbed support surface 48, anchor lip 48 and support ribs 55 and 57 which are likewise preferably integrally formed. Also, included is a preformed threaded aperture 52 in a recessed cup surface 54 formed in a like manner to that described above. Similarly, a retention lip 56 extends from an edge 58 away from and along a common frustoconical space as the base panel 42.

Figure 10:
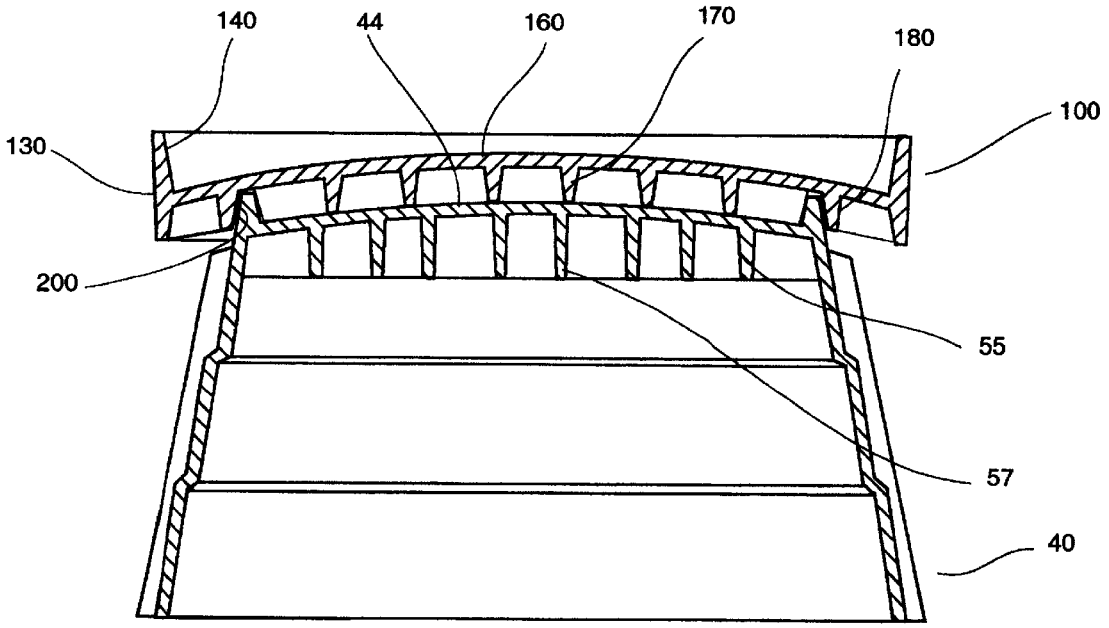
FIG. 10 is a cross sectional view of the retrofit pan of FIG. 4 and stand of FIG. 2 taken through line 10—10 of FIG. 7.

The pan 100 is similarly formed to the pan 100' above with the exception of its base 130 and retention lip 140 shape being generally cylindrical and having ribs 170 and 180 configured in accordance with such shape and having an open surface 200 formed therein to receive the retention lip 56 as shown in FIG. 10. Similarly, the ribs 170 and 180 are configured to seat on support surface 44.

The stands and pans are preferably integrally molded in separate one piece units. Thus, the above described embodiments provide for a pan and stand which can be quickly and readily employed to raise the ignitable appliance to a safe and secure height. The embodiments also provide for an appliance stand which is not susceptible to deteriorating over time and is capable of sustaining ignitable appliances of various sizes in a relatively safe manner. The stand requires little or no assembly and minimal working area in which to install. The symmetrical design aids the ease of installation in that the stand can be set in place with minimal concern as to orientation, and the stand provides means for adapting a drain pipe to a desired side or circumferential location of the stand. Also, the improved design lends well to nesting, has increased strength, and readily permit anchoring to floors.

Various other embodiments and variations of the preferred embodiments will be apparent to those skilled in the art and may be made without departing from the spirit and scope of the invention as defined by the following claims.

What is claimed is:

1. A pan for a stand for ignitable appliances of various sizes, comprising:

a base for disposal on a base foundation;

a retention lip extending from said base of said pan;

a support surface connected to said base of said pan and wherein said retention lip and said support surface form a retention surface area;

at least one aperture surface formed adjacent said retention and said support surface of said pan to which a drain pipe can be readily connected thereto and wherein said aperture is at least partially disposed beneath said support surface and extends through said base; and wherein said pan is operably disposable on the base foundation in a manner to support the ignitable appliance while permitting the drain pipe to be connected thereto such that fluid flows substantially from said support surface through said aperture surface enabling fluid to drain through the pipe.

2. The retrofit pan of claim 1, which further includes at least one support rib which connectedly extends along a bottom surface of said support surface of said pan and when said pan is disposed on the base foundation provides stability to said support surface of the pan.

3. The retrofit pan of claim 2, wherein said rib is configured to seat on the base foundation.

4. The retrofit pan of claim 2, which is further characterized as including a plurality of support ribs connected to said bottom side of said support surface of said pan.

5. The retrofit pan of claim 4, which is further characterized to include ribs extending radially inwardly from said base of said pan toward said central area of said support surface of said pan.

6. The retrofit pan of claim 5, which is further characterized to include ribs concentrically positioned in spaced relation to one another from a central area of said support surface of said pan toward said base of said pan.

7. The retrofit pan of claim 4, which is further characterized to include ribs extending radially inwardly from said base of said pan toward a central area of said support surface of said pan and ribs concentrically positioned in spaced relation to one another from said central area of said support surface of said pan toward said base of said pan and wherein said ribs form a lattice structure highly suitable for supporting the ignitable appliance.

8. The pan of claim 1, wherein said aperture surface is formed in a recessed cup surface adjacent said support surface and said retention lip.

9. The pan of claim 1, wherein said support surface of said pan is slightly dome shaped.

* * * * *